US005452365A

United States Patent [19]

Kalis

[11] Patent Number: 5,452,365

[45] Date of Patent: Sep. 19, 1995

[54] METHOD AND APPARATUS FOR MOUNTING A SPEAKER WITHIN A RADIO

[75] Inventor: Robert M. Kalis, Prairie Village, Kans.

[73] Assignee: Relm Communications, Inc., West Melbourne, Fla.

[21] Appl. No.: 216,482

[22] Filed: Mar. 22, 1994

Related U.S. Application Data

[63] Continuation of Ser. No. 4,346, Jan. 14, 1993.

[51] Int. Cl.[6] ..... H04R 25/00

[52] U.S. Cl. ..... 381/188; 381/205; 381/152; 181/150

[58] Field of Search ..... 381/188, 205, 152, 86; 181/150; 248/27.3; 455/347, 350

[56] References Cited

U.S. PATENT DOCUMENTS 3,369,784 2/1968 Whitney .
4,439,643 3/1984 Schweizer .
4,536,988 8/1985 Hogen .
4,546,850 10/1985 Litner ..... 181/150
4,685,718 8/1987 Steenblik et al. .
4,733,748 3/1988 Ponticelli, Jr. ..... 381/205

FOREIGN PATENT DOCUMENTS 0084598 5/1983 Japan ..... 381/188

*Primary Examiner*—Curtis Kuntz
*Assistant Examiner*—Sinh Tran
*Attorney, Agent, or Firm*—Banner & Allegretti, Ltd.

[57] ABSTRACT

Apparatus and method for securing a speaker within a radio housing includes a bezel connected to the grill of the radio and a rim having vertical side walls disposed along the perimeter of the bezel. The rim defines a cavity in which to position the speaker adjacent to the bezel. "U-shaped" clips having engaging barbs slidably attach to the rim until the clips provide a downward securing force against the base of the speaker. The barbs engage the rim to prevent the clips from loosening, allowing the speaker to vibrate.

5 Claims, 2 Drawing Sheets

METHOD AND APPARATUS FOR MOUNTING A SPEAKER WITHIN A RADIO

This a continuation of Ser. No. 00436, filed Jan. 14, 1993

FIELD OF THE INVENTION

This invention relates to mounting speakers. More particularly, it concerns a method and apparatus for mounting a speaker in the housing of two-way, vehicle-mounted radios.

BACKGROUND OF THE INVENTION

Two-way radios are generally mounted in emergency-type vehicles such as police cruisers, ambulances, fire fighting vehicles and other emergency-related vehicles. The radios provide multiple frequency channels for communication between other vehicles also equipped with two-way radios. The radios may be either mounted under the dash board of a vehicle or mounted in the dash if space is available.

The emergency vehicles are commonly subjected to hard driving conditions that include traveling over rough roads or terrain. It is necessary, therefore, to provide equipment mounted within the vehicle that will withstand the constant vibrations and shocks experienced by the vehicles.

In particular, the two-way radio is a vital piece of equipment in an emergency vehicle. Continual and reliable operation of the radio is critical. The radio must be designed and assembled with the driving characteristics of the emergency vehicles in mind and the durability of the radio as the objective.

The speaker is an important element in a two-way radio. It is essential that the speaker be securely mounted within the housing of the radio so vibrations and shock will not cause the speaker to loosen from its mounting. If this occurs, the speaker may be exposed to vibration which could adversely affect the sound quality of the speaker and possibly hamper radio communications.

Furthermore, the method of mounting a speaker to a radio has important design considerations. Speakers are traditionally mounted using screw fasteners or hold-down clamps. These mounting techniques require a great deal of space within the radio housing and are difficult to use in deep and confined spaces. Without an alternative means of mounting the speaker, the design of the radio is hampered, due to the wasted space that must be allocated for the speaker mounting means. The additional space used for the conventional mounting means could be used more efficiently; for example, the visual display on the radio face could be increased in size so that the radio user can more easily read the displays, or the space could be used to increase the number or size of the user controls (buttons, knobs) to make the radio more useful or easier to use.

For these reason, a method and apparatus is needed that solves the problem of a speaker loosening from its mounting within the housing of a two-way radio installed in an emergency vehicle and that also reduces the amount of space in the radio for the mounting means.

SUMMARY OF THE INVENTION

The present invention provides an apparatus and a method for securely mounting a speaker in a radio housing. The mounting apparatus comprises: a supporting member attached to or an integral part of the housing; a vertical member disposed around the outside perimeter of the supporting member, whereby the vertical member forms a cavity in which to position the speaker adjacent to the supporting member; hold-down means that attach to the vertical member and provide downward forces onto the speaker whereby the speaker is securely mounted onto the supporting member; and means for engaging the hold-down means to the vertical member whereby the hold-down means provide a constant downward force onto the speaker.

The method of securely mounting a speaker onto a radio housing comprises locating the speaker in the cavity formed by the vertical member; attaching the hold-down means to the vertical member until the hold-down means provide a downward securing force against the speaker; and engaging the hold-down means to the vertical member, whereby the hold-down means provides a constant downward force onto the speaker.

A preferred embodiment of the invention comprises a bezel in cooperation with an integral rim having vertical side walls disposed along the perimeter of the bezel. The rim defines a cavity in which to position the speaker adjacent to the bezel. "U-shaped" clips having engaging barbs slidably attach to the rim until the clips provide a downward securing force against the base of the speaker. The barbs engage the rim to prevent the clips from loosening and therefore not allowing the speaker to vibrate.

The mounting apparatus and method described below can be used in other applications that require speakers, such as stereophonic equipment, telephones, hand-held, two-way radios or other types of audio devices.

Therefore, an object of the invention is to eliminate the possibility of a speaker loosening from its mounting due to vibration and shock. Once the speaker is mounted and secured in place, the clips do not loosen due to the clip's barbs which embed themselves into the rim.

A further object of the invention is to provide a means of mounting a speaker so that the mounting means occupy a minimum amount of space within the housing.

An advantage of the invention is that it allows a speaker to be easily mounted in deep and or tightly confined enclosures.

A further advantage of the invention is that it reduces assembly time. The clips attach to the mounting assembly much faster than screws or other types of fasteners.

A further advantage of the invention is that it reduces maintenance on the radio, in particular the need to tighten the speaker mountings.

BRIEF DESCRIPTION OF THE DRAWINGS

The above and other objects and advantages of this invention will be apparent on consideration of the following detailed description, taken in conjunction with the accompanying drawings, in which like reference characters refer to like parts throughout, and in which.

DETAILED DESCRIPTION OF THE INVENTION

Figure 1:
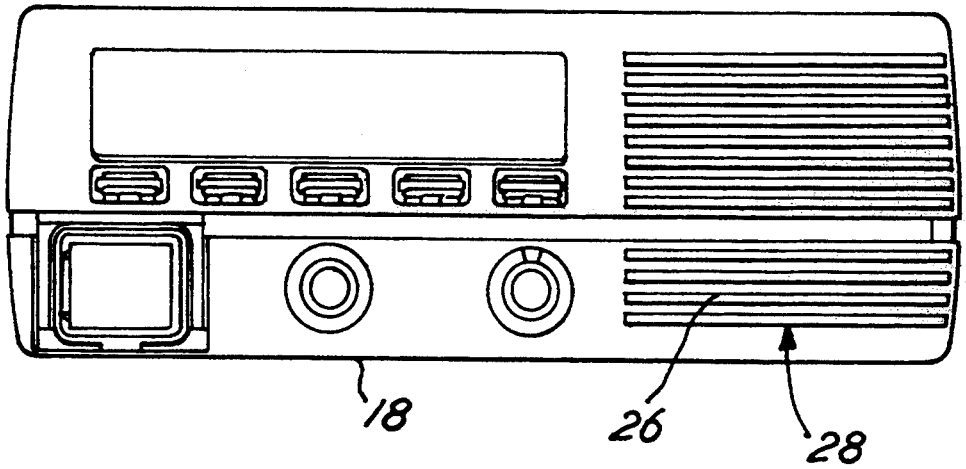
FIG. 1 is a front view of a radio housing front face in which a speaker mounts.
Figure 1A:
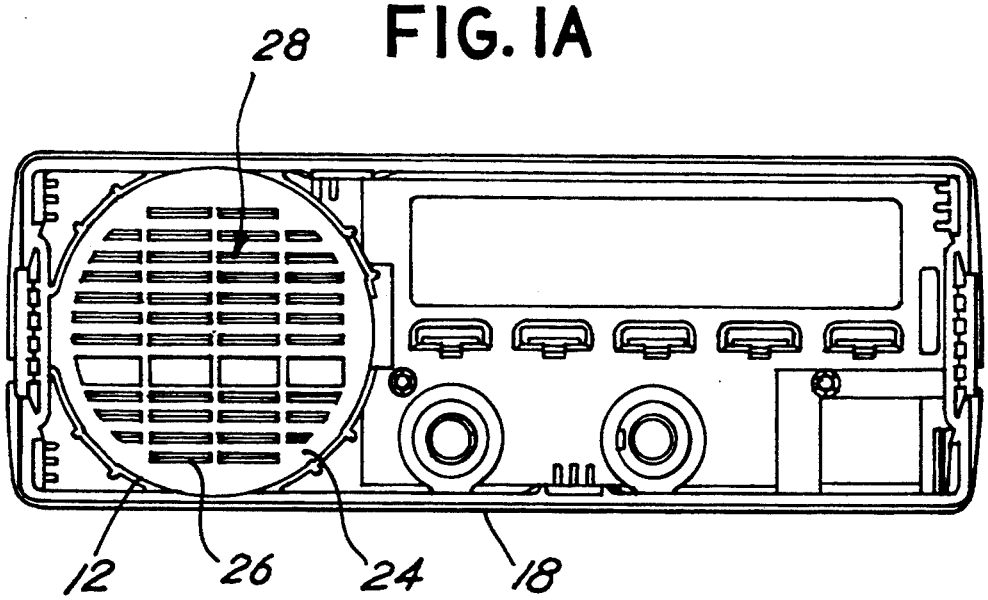
FIG. 1A is a rear view of the radio housing front face shown in FIG. 1.
Figure 2:
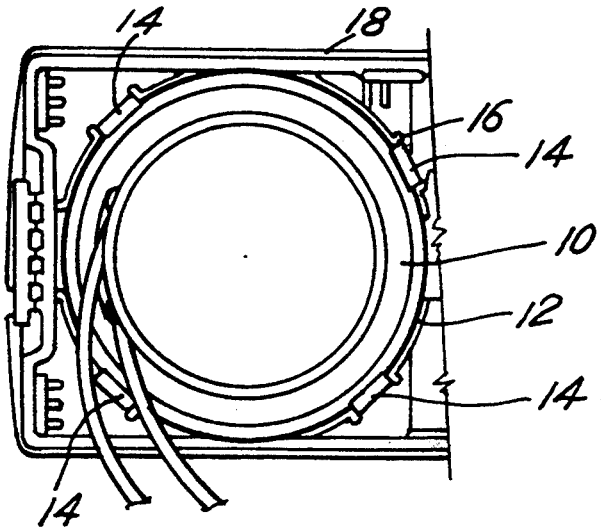
FIG. 2 is a plan view of a speaker mounted in a partial representation of the radio housing front face shown in FIG. 1A.

Referring to FIGS. 1, 1A 2, 3 and 4, a speaker 10 is supported by a bezel 24 and surrounded by a rim 12 having vertical walls in cooperation with bezel 24. In a preferred embodiment, a radio housing 18 defines a bezel 24 further comprising a network of slots 26 that define a grill 28. Grill 28 prevents physical damage to speaker 10 and slots 26 enable sound waves to pass through grill 28. Rim 12 defines a cavity in which speaker 10 mounts, supported by bezel 24. The cavity defined by rim 12 is sized to accommodate speaker 10 so that there is minimal clearance between the outside dimension of speaker 10 and rim 12. Rim 12 is further defined to include a continuous structure disposed along the perimeter of bezel 24 or a series of noncontinuous structures along the perimeter of bezel 24 as shown in FIGS. 1A and 2.

Figure 5:
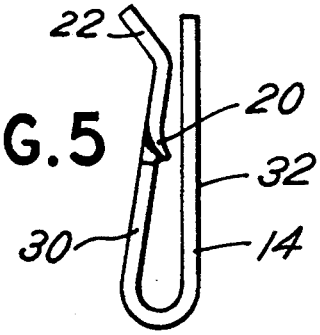
FIG. 5 is a side view of the "U-shaped" clip of the invention.
Figure 6:
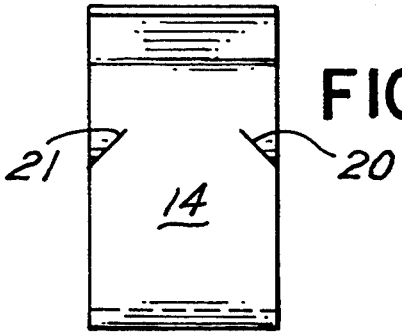
FIG. 6 is an alternate side view of the "U-shaped" clip of the invention.

FIGS. 5 and 6 illustrate the hold-down means, a U-shaped clip 14. The outside wall 30 of clip 14 turns outward to form hold-down leg 22. Leg 22 exerts a downward force at the base of speaker 10 to maintain speaker 10 securely positioned against bezel 24. Preferably, clip 14 is made from spring steel so that both outside walls 30 and 32 exert an inward pressure when they separate. Alternatively, clip 14 may be made from other metals or other materials such as plastic, so long as walls 30 and 32 exert the necessary inward pressure so that clip 14 compressively mounts onto rim 12. Preferably, clip 14 is constructed to minimize its overall dimensions to reduce the amount of space clip 14 occupies.

Figure 4:
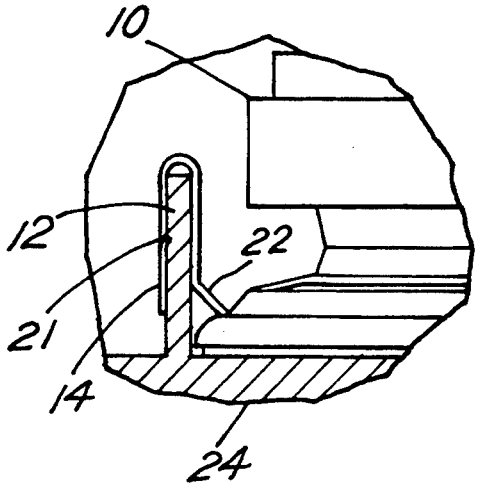
FIG. 4 is an elevation view of FIG. 3.

Clip 14 slidably attaches onto rim 12 in such a way that rim 12 separates walls 30 and 32, which then exert compressive forces against the vertical component of rim 12. In the preferred embodiment, a pair of barb members 20 and 21 project inwardly from wall 30. Both barb members 20 and 21 slide over rim 12 and grab rim 12 to prevent clip 14 from loosening from its speaker hold-down position due to external vibrations or shocks. It can be appreciated that barb members 20 and 21 may be positioned on the alternate wall 32, as shown in FIG. 4, without losing their effectiveness of preventing clip 14 from vibrating loose. Alternatively, a single barb may be positioned on either one or both walls 30 and 32.

Preferably, clips 14 slidably attach onto rim 12 at evenly-spaced intervals to provide an evenly-applied hold-down pressure against the base of speaker 10. The number of clips needed to securely hold a speaker in place depends on the overall circumference and size of the speaker. Generally, about four evenly-place clips are sufficient to securely mount a speaker up to three inches in diameter. Larger-sized speakers may require additional clips.

Figure 3:
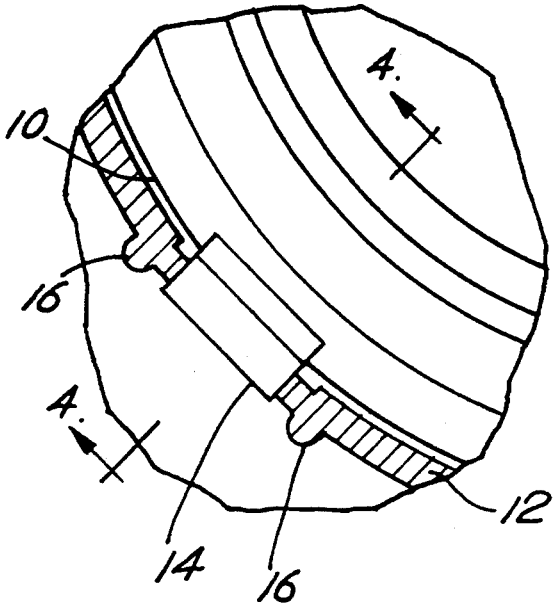
FIG. 3 is an enlarged partial plan view of the invention.

FIGS. 1A, 2 and 3 illustrate a pair of guide rails 16 for each clip 14. Each guide rail pair 16 provides a means for ensuring that clip 14 slidably attaches onto rim 12 in a properly aligned manner. The distance between each member of guide rail pair 16 is slightly greater than the width of clip 14.

It will be understood that the particular embodiments described above are only illustrative of the principles of the present invention for securing speaker 10 against bezel 24, and that various modifications could be made by those skilled in the art without departing from the scope and spirit of the present invention, which is limited only by the claims that follow.

What is claimed is:

1. An apparatus for mounting a speaker onto a radio housing comprising:

a. a supporting member in cooperation with said housing; wherein said supporting member abuts said a base of speaker:

b. a vertical member attached to said supporting member and continuously disposed along the outside perimeter of said speaker base wherein said vertical member forms a cavity in which to position said speaker: and c. a plurality of U-shaped hold-down clips each comprising a first wall and a second wall substantially parallel to the first wall, at least a portion of the first wall being turned outwardly away from the second wall so as to form a hold down leg, and at least one barb member projecting inwardly from one of said walls, said U-shaped clips slidably attached on said vertical member until said hold-down leg is securely positioned against said speaker and said barb member fixedly engages said vertical member and prevents said U-shaped clips from slidably disengaging from said vertical member;

whereby said hold-down leg exerts a constant downward force against said speaker and prevents vibration and shock forces from loosening said speaker from its mounted position.

2. The apparatus of claim 1 wherein said vertical member is a rim having vertical side walls.

3. The apparatus of claim 1 wherein said supporting member is a bezel.

4. The apparatus of claim 1 wherein said vertical member further comprises a plurality of pairs of guide rails, wherein each pair of said guide rails aligns a corresponding U-shaped clip onto said vertical member.

5. An apparatus for mounting a speaker onto a radio housing comprising:

a. a supporting member in cooperation with said housing; wherein said supporting member abuts a base of said speaker;

b. a plurality of vertical members attached to said supporting member and disposed along the outside perimeter of said speaker base, wherein said vertical members form a cavity in which to position said speaker; and c. a plurality of U-shaped hold-down clips each comprising a first wall and a second wall substantially parallel to the first wall, at least a portion of the first wall being turned outwardly away from the second wall so as to form a hold down leg, and at least one barb member projecting inwardly from one of said walls, said U-shaped clips slidably attached on said vertical member until said hold-down leg is securely positioned against said speaker and said barb member fixedly engages said vertical member and prevents said U-shaped clips from slidably disengaging from said vertical member;

whereby said hold-down leg exerts a constant downward force against said speaker and prevents vibration and shock forces from loosening said speaker from its mounted position.

* * * * *